US005725402A

United States Patent [19]

Marsh

[11] Patent Number: 5,725,402

[45] Date of Patent: Mar. 10, 1998

[54] WIRELESS MARINE PROPULSION TRIM/ TILT CONTROL SYSTEM

[76] Inventor: Gregory S. Marsh, 15135 Memorial Dr., Apt. 5109, Houston, Tex. 77079

[21] Appl. No.: 674,144

[22] Filed: Jul. 1, 1996

[51] Int. Cl.[6] ..... B63H 5/125

[52] U.S. Cl. ..... 440/53; 114/144 E

[58] Field of Search ..... 440/6, 7, 58–63; 114/144 E

[56] References Cited

U.S. PATENT DOCUMENTS 3,605,678 9/1971 Shimanckas ..... 440/58

4,614,900 9/1986 Young ..... 114/144 E 5,606,930 3/1997 LeBlanc et al. ..... 440/6

*Primary Examiner*—Jesus D. Sotelo

*Attorney, Agent, or Firm*—Arthur M. Dula

[57] ABSTRACT

A wireless remote control for the trim/tilt of a boat propulsion system including a plurality of transmitters, each capable of generating a signal on two channels and a receiver control responsive to each of the two signals and capable of synthesizing a third control signal from the combination of the two signals.

3 Claims, 3 Drawing Sheets

WIRELESS MARINE PROPULSION TRIM/ TILT CONTROL SYSTEM

TECHNICAL FIELD

The present invention relates generally to the remote control of the trim/tilt system of a boat's propulsion unit, and more particularly, to the wireless control of the trim/tilt system from a plurality of transmitters.

BACKGROUND OF THE INVENTION

In general, pleasure boats are provided with a propulsion system which is designed to move about an axis to change the trim or thrust angle of the propeller force between an upwardly inclined angle and a downwardly inclined angle. The term "trim" is generally accepted as the movement of the propulsion unit within a range of approximately 20 degrees, from −5 degrees to +15 degrees, referenced to the boats transom. Changes in water condition, passenger weight distribution, and boat speed require the operator to retrim the outboard engine, outdrive on the inboard/outboard engine, or jet pump diverter outlet to maintain optimum hull planing attitude for maximum efficiency, and performance. The term "tilt" is used to describe the movement of the propulsion unit from the fully lowered position (−5 degrees) to the fully raised position of approximately +45 degrees. Tilt is used for raising and lowering the propulsion unit when the boat is entering or leaving the water, flushing the cooling system on land, transporting the boat on a trailer, and storing the boat. It is well known in the art to provide an automatic trim adjustment which adjusts the trim of the propulsion unit as a function of the speed of the boat. (see, for example, U.S. Pat. Ser. No. 4,718,872, issued Jan. 12, 1988. Typical automatic trim systems also employ manual override switches that permit tilt.

There are three main problems with the type of trim/tilt controls taught by the prior art. The first problem is that the controls are located inside of the boat and are connected by wires to their control electronics. These controls are usually push buttons. They are typically integrated into the throttle arm, attached to the steering wheel, or mounted on the dashboard. All of these locations are in the front of the boat. When the boat is sitting on its trailer and the operator uses the trim/tilt switches to lower the propulsion unit, it is necessary to stop frequently to walk back to the stem to see how far away from the ground the propulsion unit's skeg is. Misjudging the distance and tilting the unit into the ground will damage the skeg and propeller.

The second problem is that the prior art makes it difficult to attach a trim/tilt control to the boat's steering wheel because of the requirement of a heavy water proof, usually coiled, wire that connects the trim switches to the boat's dashboard. Such wire can become tangled during turns, especially at high speeds, and impair hand and steering wheel movement.

The third problem is that prior art makes it inconvenient and time consuming for the operator to remove the boat's cover after transporting to gain access to the trim/tilt controls to lower the propulsion unit prior to storage. Manufacturers of boats and propulsion units require the unit be stored in the fully lowered position to eliminate stress on the boat's transom and the hydraulic system of the propulsion unit's trim/tilt cylinders.

SUMMARY OF THE INVENTION AND ADVANTAGES

The invention is a wireless remote control system using two transmitters with tilt/trim up and tilt/trim down push buttons on each transmitter. One transmitter is mounted on to the steering wheel for use inside the boat while the boat is underway and the other transmitter is carried by the boat operator to raise and lower the propulsion unit when it is out of the water.

The present invention allows the propulsion unit to be raised and lowered without removing the boat's cover to access controls inside the boat by an operator standing at the stem where he may observe the propulsion unit's position to ensure that it does not strike the ground or other obstacles.

Another advantage of the present invention is that it provides a tilt/trim control that may be mounted on the steering wheel of the boat without the inconvenience of wires.

Yet another advantage of the present invention is that it may provide a remote control to disable the boat's engine electrical system to deter theft, or control any other electrical device onboard.

Another advantage of the present invention is to provide a wireless remote control system that will operate with any marine propulsion unit that utilizes an electrical controlled trim and/or tilt system, or electrically controlled jet pump diverter nozzle.

Another advantage of the present invention is to provide a wireless remote control system that will operate an electrically controlled outboard engine lifting device known as a "jack plate". The jack plate supplements a typical trim system and accentuates its affect minimizing drag without requiring a high trim angle that would cause instability.

Yet another advantage of the present invention is to provide a wireless remote control to operate electrically controlled stem mounted "trim tabs" used on boats that have fixed angle propulsion systems.

DESCRIPTION OF THE PREFERRED EMBODIMENT

Figure 1:
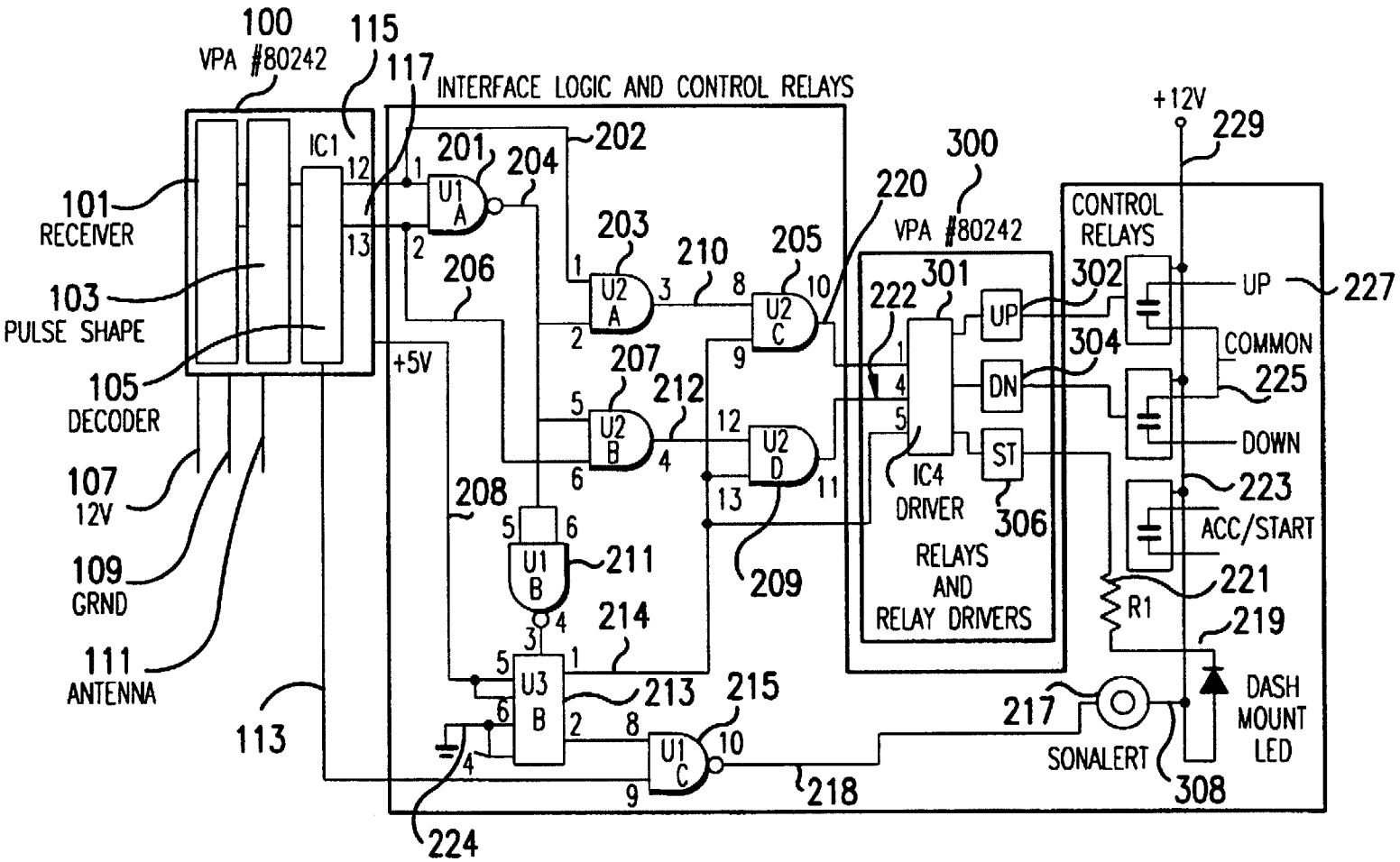
FIG. 1 is an electrical diagram showing the functional elements of the wireless remote receiver and control system taught by the present invention.

FIG. 1 is an electrical block diagram of the wireless remote control receiver taught by the preferred embodiment of the present invention.

In FIG. 1, receiver module 100 is part of a Keyless Entry System # 80242 manufactured by VPA at 369 East Blaine Street, Corona Calif. 91720. Module 100 contains radio receiver 101, pulse shaper 103 and decoder 105. The module's inputs are 12 volt line 107, ground line 109 and radio antenna 111. The module's outputs are "up" output line 115 from pin 12 of decoder which is the output of channel 1; "down" output line 117 from pin 13 of decoder 105 which is the output of channel 2, and output line 113 from pin 17 of decoder 105, which is the 'valid transmission' line.

In FIG. 1, interface logic and control relay block 200 comprises the logic circuits and relays required to translate the output of receiver module 100 to switch closures which are adapted to operate the tilt/trim system of a boat, not shown.

Control block 200 includes: gate 203, gate 205, gate 207 and gate 209, which together are a MC4081 integrated circuit; gate 201, gate 211 and gate 215, which together are a MC4011 integrated circuit; switching circuit 213, which is a MC4027 integrated circuit: audio transducer 217; and relays 221, 225 and 227, which are 20 ampere 12 volt relays.

Pin 12 of decoder 105 in module 100 is connected by line 115 to pin 1 of U1A of gate 201. Pin 1 of U1A of gate 201 is also connected by line 202 to pin 1 of U2A of gate 203. The output of gate 201 is connected by line 204 to: pin 2 of U2A of gate 203; pin 5 of gate 207; and to pins 5 and 6 of gate 211. Pin 13 of decoder 105 in module 100 is connected by line 117 to pin 2 of U1A of gate 201. Pin 2 of U1A of gate 201 is also connected by line 206 to pin 6 of gate 207. The output, pin 3, of gate 203 is connected by line 210 to pin 8 of gate 205. The output, pin 4, of gate 207 is connected by line 212 to pin 12 of gate 209. Pin 17 of decoder 105 in module 100 is connected by line 113 to pin 9 of gate 215. Pin 2 of switch circuit 213 is connected by line 16 to pin 8 of gate 215. Pin 1 of switch circuit 213 is connected to: pin 9 of gate 205; pin 13 of gate 209 and to pin 5 of relay driver section 300, which is physically part of module 100. The output, pin 10, of gate 205 is connected by line 220 to pin 1 of relay driver section 301 of module 300. The output, pin 11, of gate 209 is connected by line 222 to pin 4 of driver section 301 of module 300.

Line 208 is connected to the +5 volt pin of module 100 and to pins 5 and 6 of switch circuit 213. Pins 4 and 7 or switch circuit 213 are connected to electrical ground 224.

A twelve volt power source, not shown, is connected by line 229 to one side of the coils of relays 223,225 and 227, which are single pole normally open 12 volt 30 ampere relays. These relays are connected as switches to control the tilt/trim system of the boat.

The up output 302 of relay driver 301 is connected to the ground side of the coil of relay 227. The down output 304 of relay driver 301 is connected to the ground side of the coil of relay 225. The "start" output 306 of relay driver 301 is connected to the ground side of the coil of relay 223 and it is also connected through resistor 221, which is a 680 ohm resistor, to one side of light emitting diode 219. The diode 219 is also connected to power line 229 and by line 308 to audio transducer 217.

In FIG. 1, the VPA remote control system is shown in two parts; receiver module 100 and relay driver 300. These parts are functionally connected by interface logic 200. The output of relay driver 300 functionally engages three relays. The VPA unit is a commercially produced system designed and sold for locking, unlocking a car. It has a two channel transmitter. The interface logic of the present invention causes this two channel transmitter to be capable of generating three output states. The first state is when channel one is high, this is the 'up' signal on line 115 which controls 'up' relay 227. The second is when channel two is high, this is the 'down' signal on line 117 which controls 'down' relay 225. Both relays 227 and 225 are momentary contact, i.e., their contacts are closed only when the signals from the decoder are high and their contacts open when the signal goes low. The control logic only allows one of these two relays to close at a time. When both signal line 115 channel one and signal line 117 channel two are high, i.e. when the up and down signal are received at the same time, then the control logic changes the state of control switch 213 and this controls relay 223. If relay 223 is open, this signal closes it. If it is closed, this signal opens it. When relay 223 is open, relays 225 and 227 cannot be closed. When relay 223 is open, then the signal that would normally close relays 225 or 227 results in power to the audio transducer 217, which produces an audible tone. Relay 223 may be connected to any system that the boat owner wishes to disable, including, for example, usually the ignition system of the boat, the engine starter solenoid, the tilt and trim system hydraulic pump.

Figure 2:
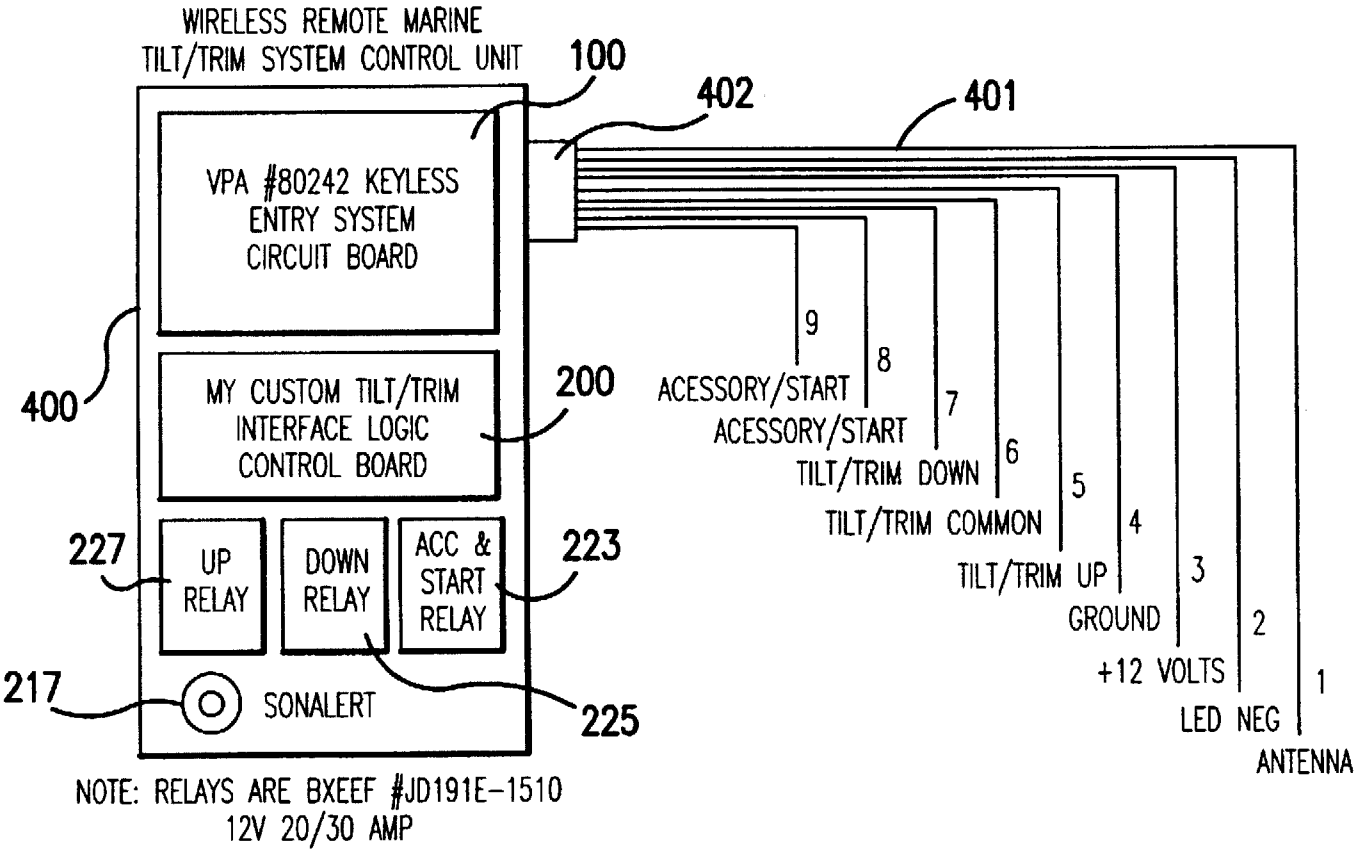
FIG. 2 is a block diagram of the receiver shown in FIG. 1 showing the electrical outputs of the receiver.

In FIG. 2, functional blocks 100, 200 and the relays 223,225 and 227 and the audio transducer 217 are disposed inside a waterproof plastic case 400, with output cable bundle 401 exiting the case through a hermetic seal 402. The inputs and outputs are labeled for identification.

Figure 3A:
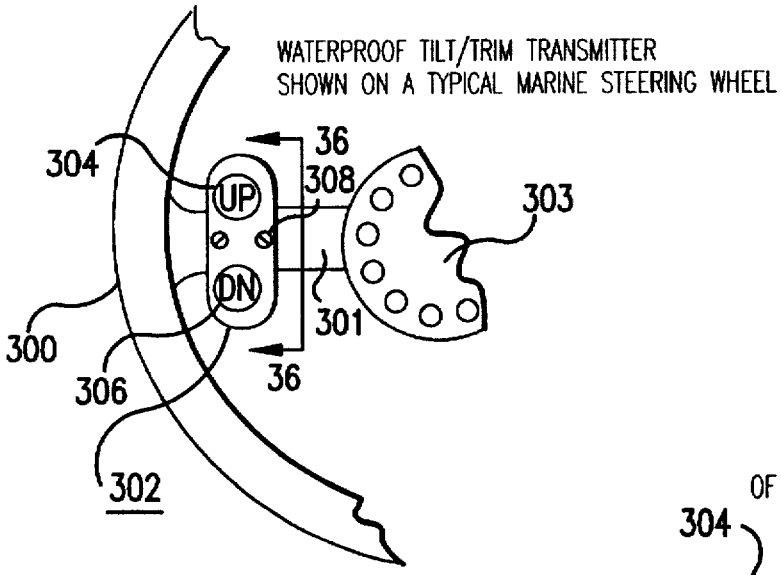
FIG. 3*a* shows the wireless transmitter of the invention mounted on a steering wheel.

In FIG. 3A, boat steering wheel 300 is connected by radial spoke 301 to hub 303. Remote control transmitter 302 is attached to spoke 301 in a position convenient to allow the operation of up button 304 and down button 306 while the boat operator is holding wheel 300.

Figure 3B:
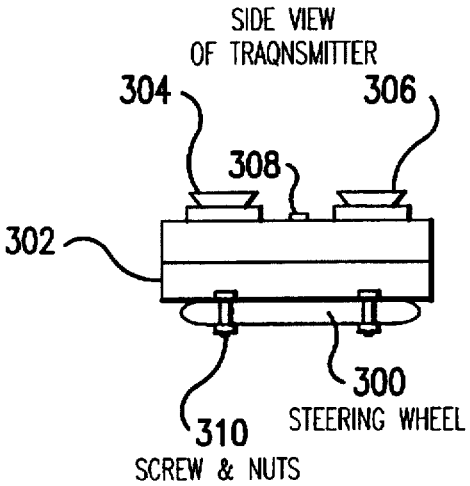
FIG. 3*b* shows a view taken on lines 3*b*–3*b* of FIG. 3*a*.

FIG. 3B is a view along section lines 3B—3B of FIG. 3A. FIG. 3B shows the transmitter 302, which is a hermetically sealed plastic housing similar in size and shape to an aluminum housing manufactured as "Steering Wheel Trim Buttons" by Land and Sea, P.O. Box 96, North Salem N.H. 03073. Up button 304 and down button 306 are shown. Screw 308 holds the two halves of the case together. Transmitter 302 is affixed to steering wheel 300 by screws and nuts 310, or by any other convenient means that will hold it firmly on the wheel.

Figure 3C:
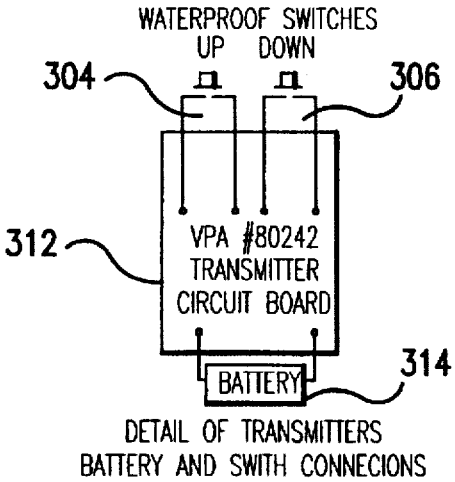
FIG. 3*c* shows the electrical block diagram of the transmitter.
Figure 3D:
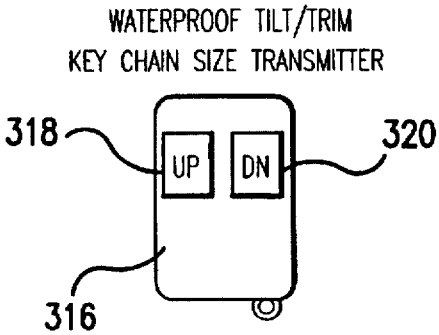
FIG. 3*d* shows the outward appearance of the handheld transmitter.

FIG. 3C shows a functional block diagram of the transmitter. The transmitter circuit board 312 from the VPA system is connected to battery 314, to waterproof 'up' switch 304 and to waterproof 'down' switch 306. FIG. 3D shows the key chain size transmitter 316 with its 'up' button 318 and 'down' button 320. This is a commercial unit delivered as part of the VPA system that is hermatically sealed.

The control system shown in FIG. 1 is mounted in any convenient place such as under the dashboard of the boat. A hole is drilled in the dashboard and the light emitting diode 217 is installed with its positive terminal connected to the 12 volt power from the boat's battery. The wiring harness is connected as shown in FIG. 2. The transmitter is then attached to the steering wheel. The key chain transmitter is complete as supplied and requires no installation.

To operate the control system, first verify that the system is enabled by checking to see if the red LED is lit. If not, then the 'up' and 'down' buttons should be pressed simultaneously on any transmitter. This will enable the control system. To move the propulsion unit, push the 'up' or 'down' button on any transmitter.

To disable the control system, push the 'up' and 'down' buttons at the same time. The control unit will emit a tone, and the LED will turn off. The control system is now disabled and subsequent activation of the up' or 'down' button on any transmitter will produce a tone, but the tilt/trim system will not be activated and the propulsion unit will not move. Any device wired through relay 223 will also be deactivated.

Although this specification has disclosed the best embodiment known to the inventor of practicing the present invention, it should not be read as limiting the invention. The invention should be limited only by the appended claims and their equivalents.

I claim:

1. A control apparatus for the relay actuated, electrically driven tilt/trim system of a marine propulsion unit of a boat comprising:

a plurality of wireless transmitter means for creating signals, each transmitter means having a first control means for selectively producing a first wireless signal in response to a first external command and a second control means for selectively producing a second wireless signal responsive to a second external command;

receiver means for detecting said first and second wireless signals;

first decoding means responsive to the receiver means for producing a first electrical output responsive to said first signal and a second electrical output responsive to said second signal;

relay means responsive to the electrical output of the decoding means for providing a first relay closure responsive to said first electrical output and a second relay closure responsive to said second electrical output, said relay means being adapted to actuate said electrically driven tilt/trim system;

a third decoding means responsive to the receiver means for producing a third electrical output responsive to the combination of the first signal and the second signals, and;

a third relay means responsive to said third electrical output for controlling the flow of electricity to the boat.

2. An apparatus as in claim 1 including;

switching circuit means responsive to said third electrical output for locking the state of the second relay.

3. An apparatus as in claim 2 wherein the plurality of the transmitters comprises a first transmitter affixed to the boat and a second transmitter not affixed to the boat.

* * * * *